United States Patent [19]

Clarke

[11] 4,224,742

[45] Sep. 30, 1980

[54] PORTABLE DRAWING APPARATUS

[76] Inventor: Lloyd E. Clarke, 1145 Dean St., Apt. 3, Brooklyn, N.Y. 11216

[21] Appl. No.: 46,856

[22] Filed: Jun. 8, 1979

[51] Int. Cl.[3] ..... B43L 13/02

[52] U.S. Cl. ..... 33/443

[58] Field of Search ..... 33/443, 430, DIG. 1; 248/441 B, 441 C

[56] References Cited

U.S. PATENT DOCUMENTS

| | | | |
|---|---|---|---|
| 1,126,410 | 1/1915 | Daly | 248/441 C |
| 3,086,291 | 4/1963 | Harrison | 33/446 |

FOREIGN PATENT DOCUMENTS

| | | | |
|---|---|---|---|
| 721920 | 11/1965 | Canada | 248/441 B |
| 15657 | 10/1881 | Fed. Rep. of Germany | 33/DIG. 1 |
| 54229 | 11/1967 | Fed. Rep. of Germany | 33/443 |
| 323769 | 11/1902 | France | 33/443 |
| 602244 | 12/1925 | France | 33/DIG. 1 |
| 734559 | 8/1932 | France | 248/441 B |

*Primary Examiner*—Harry N. Haroian
*Attorney, Agent, or Firm*—Richard L. Miller

[57] ABSTRACT

A drafting set, including a drawing board and a T-square, the board having a foldable easel on its rear side for supporting the board in various adjustable positions, the T-square including a slidable shoe on its outward end for bearing against an edge of the board which is opposite an edge against which the T-square crosshead bears, and permanent magnet means holding the shoe and crosshead from falling away from the board edges.

3 Claims, 9 Drawing Figures

PORTABLE DRAWING APPARATUS

BACKGROUND OF THE INVENTION

This invention relates generally to engineers' drafting boards and T-squares such as are used in conjunction with drafting boards.

It is well known to those acquainted with the specific field, that a T-square must be firmly held by a hand, so that the T-square crosshead abuts a drawing table edge in order that all horizontal lines of a drawing drawn along the T-square edge are precisely parallel to each other, and all other lines of the drawing are precisely accurate relative thereto. If the T-square is tilted, even minimally, the drawing is inaccurate. It is also well known to those acquainted in the particular field that a small drawing board supported in a person's lap or rested against loose objects upon a desk, is not as stable a base as a large drafting table for a T-square to be firmly abutted against its edge, so that this situation is, accordingly, in need of an improvement.

SUMMARY OF THE INVENTION

Accordingly, it is a principal object of the present invention to provide a portable drawing apparatus in which a T-square is firmly abutted against a small drawing board edge without the necessity of a person holding it thereagainst with his hand.

Another object is to provide a portable drawing apparatus wherein a small drawing board includes its own easel that is fully adjustable, so that the board is supported more stable instead of propped against loose objects.

Still another object is to provide a portable drawing apparatus wherein the easel is designed so that it can be supported in various positions, in order to be used either on top of a desk, an edge of a table or on a lap while seated in a chair or in bed.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows:

FIG. 1 is a front perspective view of the invention.

FIG. 2 is a rear elevation view thereof.

FIG. 3 is an enlarged cross-section on line 3—3 of FIG. 1.

FIG. 4 is a side cross-sectional view on line 4—4 of FIG. 2, shown as an inclined easel.

FIG. 5 is a side view thereof turned 90° degrees and used as an inclined easel.

FIG. 6 is a similar view thereof held up by clipping around an edge of a table top or the like.

FIG. 7 is an enlarged cross-sectional view on line 7—7 of FIG. 2.

FIG. 8 is an enlarged cross-sectional view on line 8—8 of FIG. 2.

FIG. 9 is a perspective view of the foot that grasps both wire braces.

DETAILED DESCRIPTION OF PREFERRED EMBODIMENT

Figures 1, 2, 3, 4, 5, 6, 7, 8, 9:
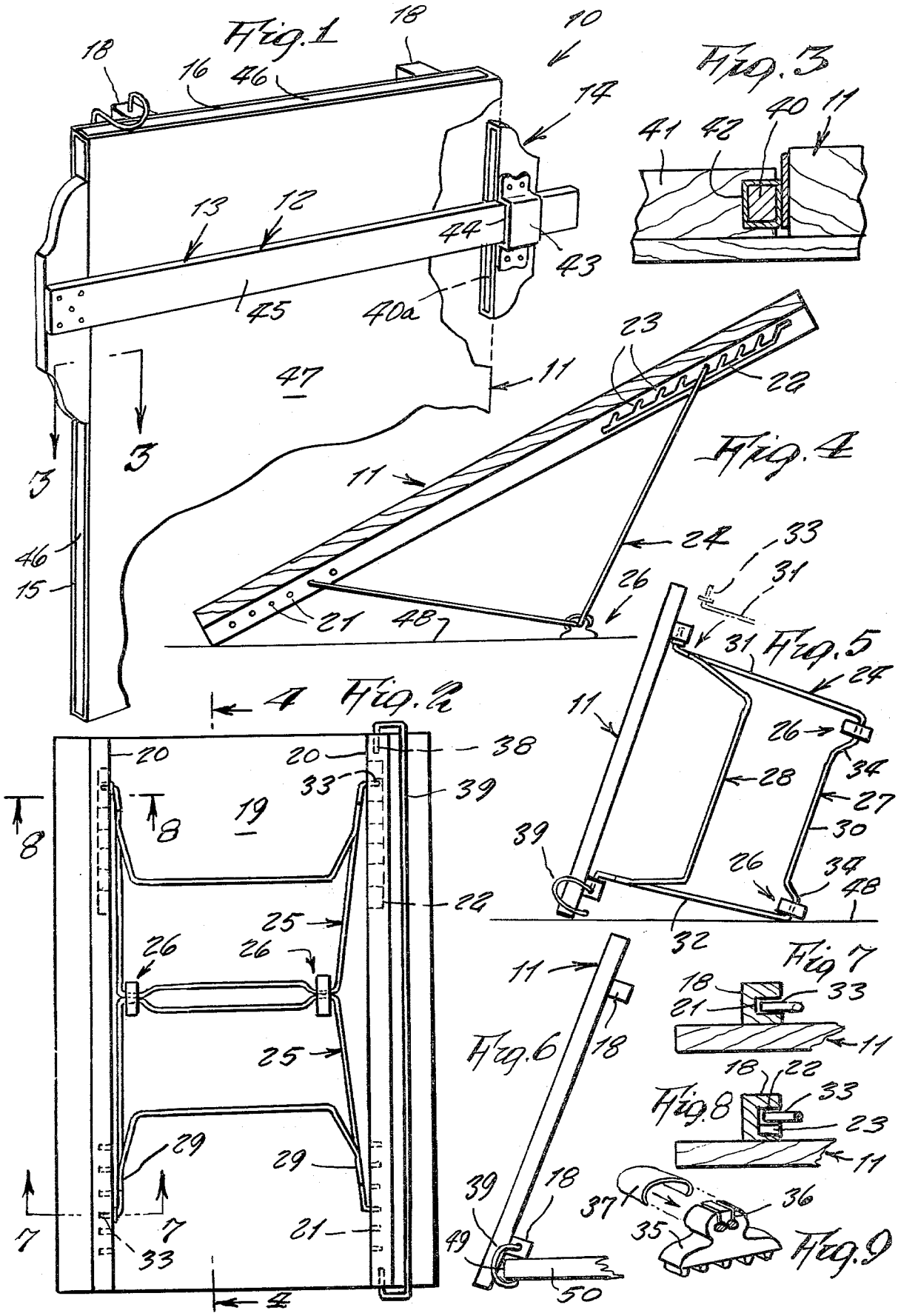

Referring now to the drawing in greater detail, the reference numeral 10 represents a portable drawing apparatus according to the present invention, wherein there is a small drawing board 11 and a T-square assembly 12 comprised of a T-square 13 and shoe 14.

The drawing board 11 is of rectangular shape with parallel opposite side edges 15 and parallel upper and lower edges 16 and 17. A pair of parallel runners 18 are affixed to a rear side 19 of the board. A side 20 of each runner which faces toward the other runner is provided with a row of holes 21 near one end thereof, and an elongated slot 22 near its other end, the slot having a plurality of parallel, equally spaced apart notches 23 extending angularly therefrom, as clearly shown in FIG. 2.

A foldable easel 24 is adjustably mounted in the holes 21 and the slot notches 23, as also shown in FIG. 2, so that the board can be held at selected inclined angle.

The easel is comprised of two, like wire frames 25 pivotally connected together by means of a pair of feet 26. Each frame is comprised of two stiff wires 27 and 28 bent into the flat configuration shown in FIG. 5, and the wires being welded together at places 29. It is to be noted that a leg 30 of wire 27 is at 90 degree angle to a leg 31 but is at an acute angle respective to a leg 32 thereof. The ends 33 of one frame 25 fit in the holes 21, while the ends 33 of the other frame 25 fit in the slot 22 and selectively in notches 23. The feet 26 are located along offset portions 34 of leg 30. Each foot comprises a molded rubber member 35 having two slits 36 receiving the legs 30, the slits being thereafter held closed by a spring metal clip 37.

One of the runners 18 additionally has a hole 38 in opposite ends thereof for pivotally supporting a generally U-shaped wire member 39, which in an end view thereof is C-shaped as shown in FIGS. 5 and 6.

The T-square 13 includes a permanent magnet bar 40 imbedded in its crosshead 41, the bar being coated with a plastic film 42.

The shoe 14 is made similar in shape to the crosshead except that it is fitted with a bracket 43 so as to form a slot 44 through which the T-square straight edge 45 extends. A magnet bar 40a similar to bar 40, and similarly coated is imbedded similarly in the edge of the shoe.

A steel strip 46 is affixed to all edges 15, 16 and 17 of the board.

In use, the straight edge 45 extends across a front side 47 of the board. The crosshead and shoe hold the assembly firmly abutted against the board edges.

The easel can lay flat against the board's rear side as shown in FIG. 2, or pivoted out as shown in FIG. 4 so as to rest thereupon. Alternately, the board can be turned 90 degrees so as to rest on a side edge and the acute corner of the frames 25 as shown in FIG. 5. By turning the other way around, the square corner of the frame rests against supporting surface 48.

Alternately, as shown in FIG. 6, the device can be supported around an edge 49 of a table top 50 by the wire member 39 hooking therearound.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A portable drawing apparatus, comprising in combination, a drawing board and a T-square assembly slidable thereupon, said T-square assembly being comprised of a T-square and a shoe slidable on an outward end of said T-square; said drawing board including a foldable easel adjustably mounted on a rear of said board, said easel comprising two generally U-shaped wire frames, a central leg of each said frames being pivotally connected to a same pair of feet, the ends of one said frame being selectively received in a row of holes near one end of a rear of said board, while the ends of the other said frame is selectively received in a row of inclined notches of a slot near an opposite end of a rear of said board.

2. The combination as set forth in claim 1 wherein permanent magnets are imbedded in an edge of a cross-head of said T-square and in an edge of said shoe, while a steel strip is affixed to all edges of said drawing board.

3. The combination as set forth in claim 2 wherein a wire member is pivotally attached to said board for clipping around a table top edge.

* * * * *